United States Patent [19]

Moontasir

[11] 4,392,630

[45] Jul. 12, 1983

[54] SOAP HOLDERS

[76] Inventor: Hussain A. Moontasir, 2 High Park Rd., Kew Gardens, Surrey, England

[21] Appl. No.: 196,326

[22] Filed: Oct. 14, 1980

[30] Foreign Application Priority Data

Oct. 12, 1979 [GB] United Kingdom ..... 7935597

[51] Int. Cl.[3] ..... A47K 5/08

[52] U.S. Cl. ..... 248/309 R; 312/351; 312/229

[58] Field of Search ..... 312/351, 15, 18, 229; 211/126; 248/309 R; 206/806

[56] References Cited

U.S. PATENT DOCUMENTS

| | | | |
|---|---|---|---|
| 1,145,712 | 7/1915 | Stevens, Jr. | 312/15 |
| 1,702,987 | 2/1929 | Wilson | 211/126 |
| 1,889,501 | 11/1932 | Schnake | 312/351 |
| 2,362,367 | 11/1944 | Freeman | 211/126 |
| 2,532,673 | 12/1950 | Mossett | 312/15 |
| 2,662,718 | 12/1953 | Stickler | 248/309 R |
| 2,768,048 | 10/1956 | Schumacher | 312/351 |
| 3,054,211 | 9/1962 | Hawk et al. | 312/351 |
| 3,177,048 | 4/1965 | Whatley | 312/351 |
| 3,206,271 | 9/1965 | Burros | 312/351 |
| 4,313,537 | 2/1982 | Collet | 248/309 R |

FOREIGN PATENT DOCUMENTS

| | | | |
|---|---|---|---|
| 1379694 | 1/1975 | United Kingdom | 312/351 |

*Primary Examiner*—Victor N. Sakran

*Attorney, Agent, or Firm*—Brisebois & Kruger

[57] ABSTRACT

A soap holder comprises a tray-like member for holding a bar of soap. Below the tray-like member there is disposed an actuatable member which is connected to a member for causing the soap to be discharged from the tray-like member into the palm of a user's hand when the actuatable member is actuated. Thus the user does not have to pick up the soap with his fingers and therefore the likelihood of soap becoming embedded under his nails is lessened.

6 Claims, 2 Drawing Figures

SOAP HOLDERS

BACKGROUND OF THE INVENTION

The present invention relates to soap holders which are used to hold bars of soap adjacent wash basins and, more particularly, to a soap holder which can be actuated, when desired, in order to dispense or discharge the bar of soap into the hand of the user.

Hitherto, soap holders have typically comprised a tray, dish or similar receptacle for retaining a bar of soap in a desired position. When a user picks up a bar of soap from such a receptacle it often occurs that the persons finger nails, particularly when the person has long nails, dig into the soap, with the result that soap is lodged under the nails or even breaks long nails. This is at least inconvenient and the soap can be difficult to remove.

SUMMARY OF THE INVENTION

An object of the present invention is to provide a soap holder which overcomes or alleviates the above-mentioned problems.

To this end, the invention consists in a soap holder comprising a tray-like member for holding a bar of soap, and an actuatable member disposed below the tray-like member and connected to means which causes the discharge of the soap from the tray-like member when the actuatable member is actuated, whereby upon actuation of the actuatable member the soap is discharged into the palm of a user's hand. Hence, a user does not have to use his or her fingers to pick up the bar of soap and thus the problems mentioned above are avoided.

Conveniently, the actuatable member is a hand-operated member. The hand operated member may be connected to a push member, such as a flat bar or the like, arranged to push the soap off the tray-like member when the hand-operated member is actuated.

The hand-operated member and push member may be pivotally mounted on a common, substantially horizontal axis. In one embodiment, the hand-operated member and push member are supported by means pivotally mounted on the holder above the tray-like member, whereby the hand-operated member can be pulled by the fingers of a person's hand to cause the push member to push the soap off the tray-like member and into the palm of the hand.

The soap holder may be adapted to facilitate securing to a wall above a basin.

DESCRIPTION OF THE DRAWINGS

In order that the present invention may be more readily understood, reference will now be made to the accompanying drawings, in which.

DESCRIPTION OF THE PREFERRED EMBODIMENT

Figure 1:
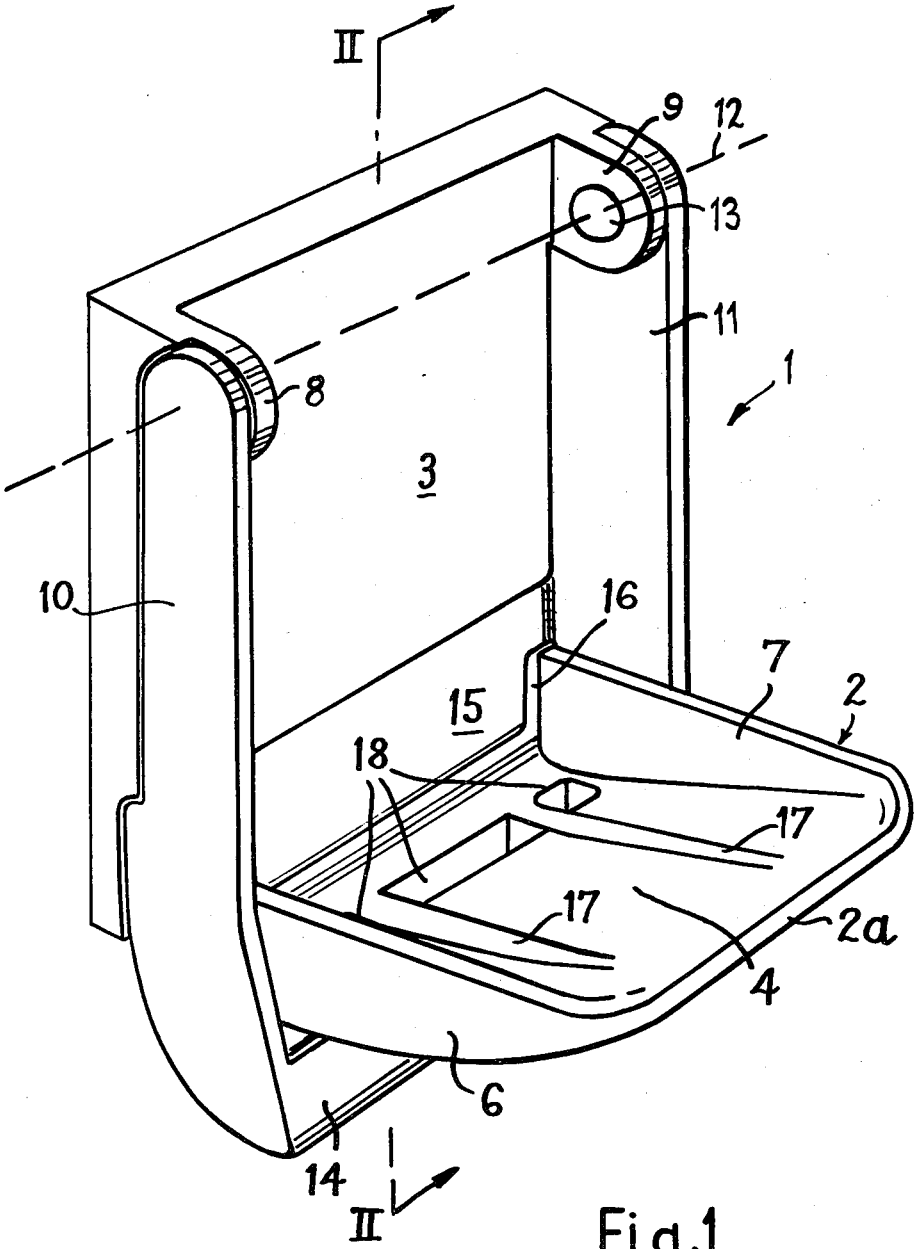
FIG. 1 is a perspective view of one embodiment of soap holder according to the invention.
Figure 2:
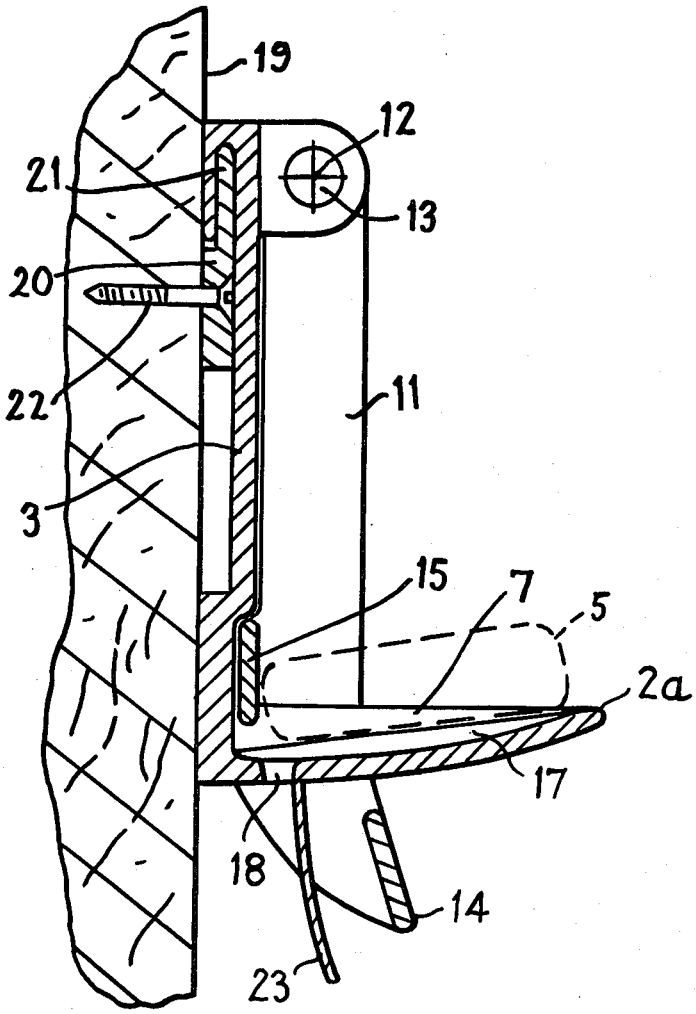
FIG. 2 is a cross-sectional view of the holder of FIG. 1 taken on the line II—II.

Referring to the drawings, a soap holder 1 comprises a tray-like member 2 which extends forwardly from a rear wall 3 of the holder. The tray-like member 2 has a base 4 for locating a bar of soap 5, an open front 2*a*, and side walls 6, 7. Lugs 8, 9 project forwardly from opposite sides of the rear wall at the upper end thereof. Vertically extending support arms 10, 11 are mounted on the lugs 8, 9 to pivot about a horizontal axis 12 by means of pivot pins 13.

The support arms 10, 11 extend down past the outsides of the opposite side walls 6, 7 of the tray-like member. A flat hand-operated member 14 extends between the lower ends of the support arms 10, 11 so as to be located below the tray-like member, and a flat push member 15 extends between the support arms at a region just above the base 4 of the tray-like member. The push member 15 includes transverse recesses or cut-out portions 16 at its opposite ends to accommodate the side walls 6, 7 of the tray-like member.

The push member 15 extends between the rear edges of the support arms 10, 11 and in its rest or inoperative position is located adjacent the front surface of the rear wall 3 of the tray-like member. The hand-operated member 14 extends between the front edges of the support arms and is thus located both below and in front of the push member 15.

The base 4 of the tray-like member is generally of concave form and slopes downwardly from the open front 2*a* towards the rear wall 3. This construction prevents the bar of soap accidently slipping off the front. A pair of ridges 17 extending parallel to the side walls 6, 7 are provided in the base 4 of the tray-like member for supporting the bar of soap 5. Drain apertures 18 are provided in the base towards the rear of the tray-like member so that residual water off of the soap can drain from the tray-like member. A curved wall 23 extends across the underside of the tray-like member 2 between the support arms 10,11 and depends from the front of the apertures 18 such that water passing through the apertures can drain down the convex rear surface of the wall 23. Thus the tray-like member is self-draining.

In use, the soap holder 1 is mounted on a wall 19 above a wash basin (not shown) by means of a batten or the like 20 which is secured to the wall by screws 22 and has an upper projection 21 over which the rear wall 3 is hooked. When the bar of soap 5 is to be used, a person engages the back of the hand-operated member 14 with the fingers of one hand, with the palm facing up, and pulls the hand-operated member forward. This causes the support arms 10,11 to pivot about the horizontal pivot axis 12 and the push member 15 to be moved forwardly and push the soap off the front of the tray-like member 2 into the palm of the user's hand.

The support arms may return to their initial vertical positions under the action of gravity or, alternatively, they may be returned manually.

Whilst a particular embodiment of the invention has been described, it wil be understood that various modifications may be made without departing from the scope of the invention.

I claim:

1. A soap holder comprising, in combination:

(a) a tray-like member having a base part for holding a bar of soap on one surface thereof, (b) means for mounting said tray-like member in a generally horizontal position projecting from back to front of said soap holder and with said base part surface facing upwardly, (c) push means located closely above said base part surface of said tray-like member, (d) means mounting said push means for reciprocating movement between a rest position at the back of said tray-like member and the front thereof, and (e) actuating means located below said tray-like member and adapted to move said push means, (f) said actuating means being operable to advance said push means towards said front of said tray to dispense said bar of soap from said front thereof, whereby said bar can be delivered into the palm of a user's hand operating said actuating means.

2. The soap holder of claim 1, wherein said mounting means supports said push means for swinging movement about a generally horizontal axis, and said actuating means is a hand-operated member connected to said push means.

3. The soap holder of claim 2, wherein said mounting means includes arm means integrally connected with said push means and said hand-operated member and pivotally mounted on said soap holder generally above said back of said tray-like member, whereby said hand-operated member is adapted to be pulled by the fingers of a user's hand to cause said push means to dispense said soap from said front of said tray-like member and thereafter said push means and hand-operated member can return to said rest position under the action of gravity.

4. The soap holder of claim 2, wherein said base part surface of said tray-like member slopes downwardly from said front of said member towards said back thereof and is of generally concave form.

5. The soap holder of claim 2, wherein said tray-like member is provided with at least one aperture adjacent said back thereof to permit water to drain from said tray-like member, and said hand-operated member is located forwardly of said drain aperture in said rest position of said push means.

6. The soap holder of claim 3, wherein said arm means comprises a pair of generally vertically extending support arms pivotally connected to a rear wall of said soap holder and extending downwardly outside opposite sides of said tray-like member to a position below said tray-like member, said hand-operated member extends between the lower ends of said support arms below said tray-like member, and said push means comprises a push member extending between said support arms in a region immediately above said base part surface of said tray-like member, and means is provided for fixing said holder to a wall with said rear wall of said holder juxtaposed thereto.

* * * * *